US009103297B2

(12) United States Patent
Brandt et al.

(10) Patent No.: US 9,103,297 B2
(45) Date of Patent: Aug. 11, 2015

(54) ADAPTIVE IDLE STROKE COMPENSATION FOR FUEL INJECTION VALVES

(75) Inventors: Martin Brandt, Wörth a.d. Donau (DE); Janos Radeczky, Wenzenbach (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 215 days.

(21) Appl. No.: 13/699,152

(22) PCT Filed: May 4, 2011

(86) PCT No.: PCT/EP2011/057107

§ 371 (c)(1),
(2), (4) Date: Nov. 20, 2012

(87) PCT Pub. No.: WO2011/144445

PCT Pub. Date: Nov. 24, 2011

(65) Prior Publication Data

US 2013/0066538 A1 Mar. 14, 2013

(30) Foreign Application Priority Data

May 21, 2010 (DE) ..... 10 2010 021 168

(51) Int. Cl.
*F02D 41/34* (2006.01)
*F02D 41/20* (2006.01)
(Continued)

(52) U.S. Cl.
CPC ..... *F02D 41/345* (2013.01); *F02D 41/2096* (2013.01); *F02D 41/2416* (2013.01);
(Continued)

(58) Field of Classification Search
CPC ..... F02D 41/2096; F02D 41/2467; F02D 41/2416; F02D 41/2438; F02D 41/345; F02D 41/2051; F02D 2200/0602; F02D 2200/0618; F02D 41/401; F02D 41/247; F02M 47/027; F02M 63/0026; F02M 65/005
USPC ..... 123/472, 475, 478, 486, 488; 701/101, 701/102, 103, 105
See application file for complete search history.

(56) References Cited

U.S. PATENT DOCUMENTS 6,885,131 B2 4/2005 Hirn et al. ..... 310/316.01
7,191,051 B2 3/2007 Rueger et al. ..... 701/104
(Continued)

FOREIGN PATENT DOCUMENTS

DE 19905340 A1 8/2000 ..... F02D 41/20
DE 10012607 A1 9/2001 ..... F02D 41/20
(Continued)

OTHER PUBLICATIONS

German Office Action, Application No. 10 2010 021 168, 3 pages, Oct. 14, 2010.
(Continued)

*Primary Examiner* — Thomas Moulis
*Assistant Examiner* — Elizabeth Hadley
(74) *Attorney, Agent, or Firm* — Slayden Grubert Beard PLLC

(57) ABSTRACT

A method is provided for operating an internal combustion engine having an injection system comprising at least one injector indirectly driven by means of an actuator, and a high pressure accumulator. According to the method, the actuator of the at least one injector has electrical test pulses of iteratively increasing energy continuously applied thereto, and the idle stroke of the actuator is continuously determined by hydraulic and/or electric means. Upon detecting a change in the idle stroke, a corresponding correction of the injection time of the injector is carried out.

8 Claims, 4 Drawing Sheets

(51) Int. Cl.

| | |
|---|---|
| ***F02D 41/24*** | (2006.01) |
| ***F02M 47/02*** | (2006.01) |
| ***F02M 63/00*** | (2006.01) |

(52) U.S. Cl.

CPC ..... *F02D41/2438* (2013.01); *F02D 41/2467* (2013.01); *F02M 47/027* (2013.01); *F02M 63/0026* (2013.01); *F02D 2041/2051* (2013.01); *F02D 2200/0602* (2013.01)

(56) References Cited

U.S. PATENT DOCUMENTS

| | | | | |
|---|---|---|---|---|
| 7,406,861 | B2 * | 8/2008 | Jung et al. | 73/114.45 |
| 7,406,952 | B2 * | 8/2008 | Frank et al. | 123/498 |
| 7,765,054 | B2 * | 7/2010 | Jung et al. | 701/105 |
| 7,905,136 | B2 * | 3/2011 | Sutter et al. | 73/114.51 |
| 8,631,785 | B2 * | 1/2014 | Marzahn et al. | 123/478 |
| 8,726,885 | B2 * | 5/2014 | Brandt | 123/478 |
| 8,812,412 | B2 * | 8/2014 | Yamada | 706/12 |
| 2009/0090333 | A1 * | 4/2009 | Spadafora et al. | 123/494 |
| 2010/0095936 | A1 * | 4/2010 | Schempp | 123/478 |
| 2012/0004822 | A1 * | 1/2012 | Siedentopf et al. | 701/103 |
| 2012/0031378 | A1 | 2/2012 | Brandt | 123/490 |
| 2012/0036938 | A1 | 2/2012 | Brandt | 73/753 |
| 2013/0066538 | A1 | 3/2013 | Brandt et al. | 701/105 |
| 2013/0152902 | A1 * | 6/2013 | Brandt et al. | 123/480 |
| 2013/0327301 | A1 * | 12/2013 | Brandt | 123/478 |
| 2014/0060488 | A1 * | 3/2014 | Katzenberger et al. | 123/456 |

FOREIGN PATENT DOCUMENTS

| | | | | |
|---|---|---|---|---|
| DE | 10319530 | A1 | 11/2004 | F02D 41/20 |
| DE | 10349307 | B3 | 5/2005 | F02D 41/20 |
| DE | 102004044450 | B3 | 4/2006 | F02D 41/20 |
| DE | 102005001498 | A1 | 7/2006 | F02D 41/20 |
| DE | 102009018289 | B3 | 6/2010 | F02D 41/20 |
| DE | 102009018288 | A1 | 10/2010 | F02D 41/00 |
| WO | 02/092985 | A1 | 11/2002 | F02D 41/20 |
| WO | 2004/048763 | A1 | 6/2004 | F02D 41/20 |
| WO | 2006/029931 | A1 | 3/2006 | F02D 41/042 |
| WO | 2011/144445 | A1 | 11/2011 | F02D 41/20 |

OTHER PUBLICATIONS

International Search Report and Written Opinion, Application No. PCT/EP2011/057107, 32 pages, Aug. 2, 2011.

* cited by examiner

ADAPTIVE IDLE STROKE COMPENSATION FOR FUEL INJECTION VALVES

CROSS-REFERENCE TO RELATED APPLICATIONS

This application is a U.S. National Stage Application of International Application No. PCT/EP2011/057107 filed May 4, 2011, which designates the United States of America, and claims priority to DE Application No. 10 2010 021 168.0 filed May 21, 2010, the contents of which are hereby incorporated by reference in their entirety.

TECHNICAL FIELD

The present disclosure relates to a method for operating an internal combustion engine which has an injection system comprising at least one injector, which is indirectly driven by means of an actuator, and a high-pressure accumulator.

BACKGROUND

In indirectly driven fuel injectors, an actuator, in particular a piezo-actuator, controls the valve piston of a control valve with which the pressure ratios between the control space and the valve space are influenced. The movement of the control valve piston is determined here by the respectively prevailing force conditions (pressure in the control space and actuator space as well as the force/expansion brought about by the actuator). If an injection is to be triggered, electrical energy is applied to the actuator. The actuator can be actuated here, for example, in an energy-controlled fashion. For this, the charge current and the voltage at the actuator are measured in parallel and the current energy is determined according to the formula $$E=0.5*\int (I_PIEZO)dt*U_PIEZO.$$

In the case of a piezo-actuator, the actuator expands owing to the piezo-electric effect and applies a force to the valve piston of the control valve. If the actuator force exceeds the opposing force, the control valve opens and the pressure in the control space is reduced. The force conditions at the valve needle change as a function of the ratio of the fuel quantity running into the control space and the fuel quantity running out of the control space, said valve needle moving in accordance with the resulting force and clearing the injection holes. In order to end the injection, the actuator is discharged after a predetermined time and the control valve is closed. The pressure which builds up in the control space closes the injection valve by means of the movement of the valve needle.

The quantity tolerances of the individual injectors, in particular over their service life, are influenced here, in particular, by mechanical tolerances, the temperature, the run-in behavior and the wear. As a result, a switching leak can occur in the corresponding injector. The energy requirement of the actuator, in particular piezo-actuator, which is required to open the control valve plays a central role in the size of the respective quantity tolerances. This energy requirement corresponds to a stroke which is to be overcome by the actuator and which is referred to as an idle stroke. For this reason, the ACTUAL INJECTION differs from the SETPOINT INJECTION as a result of changes to this idle stroke due to wear, service life, temperature, load profile, etc.

SUMMARY

In one embodiment, a method is provided for operating an internal combustion engine which has an injection system comprising at least one injector, which is indirectly driven by means of an actuator, and a high-pressure accumulator, the method comprising the following steps: continuously applying electrical test pulses with iteratively increasing energy to the actuator of the at least one injector during operating phases in which no pump delivery or normal injection takes place, and continuously hydraulically determining the idle stroke of the actuator by determining the pressure drop which is brought about thereby in the high-pressure accumulator; and making a corresponding correction to the injection time of the injector when a change in the pressure drop and therefore a change in the idle stroke compared to a comparison value are detected.

In another embodiment, a method is provided for operating an internal combustion engine which has an injection system comprising at least one injector, which is indirectly driven by means of an actuator, and a high-pressure accumulator, the method comprising the following steps: continuously applying electrical test pulses with iteratively increasing energy to the actuator of the at least one injector, and continuously electrically determining the idle stroke of the actuator by determining the voltage drop brought about thereby at the actuator of the injector; and making a corresponding correction to the injection time of the injector when a change in the voltage drop and therefore a change in the idle stroke are detected.

In a further embodiment, the continuous hydraulic and the continuous electrical determination of the idle stroke are combined with one another, in particular are carried out in parallel with one another. In a further embodiment, hydraulic, electrical or combined determination of the idle stroke is carried out as a function of the respective working point of the internal combustion engine. In a further embodiment, the hydraulic idle stroke determination is carried out in the lower pressure range of the high-pressure accumulator and/or lower rotational speed range of the internal combustion engine. In a further embodiment, combined hydraulic and electrical idle stroke determination is carried out in a central pressure range of the high-pressure accumulator (transition region). In a further embodiment, in the case of combined hydraulic and electrical determination of the idle stroke, the measured pressure drop and voltage drop are placed in relationship with one another and a transmission function, which is used in the electrical idle stroke determination as the reference function, is determined therefrom. In a further embodiment, in pressure ranges in which no parallel hydraulic and electrical idle stroke determination can take place, a reference voltage curve is formed from an overlapping pressure range from the profile of the reference voltage curve by means of a model.

In another embodiment, an internal combustion engine includes an injection system comprising at least one injector, which is indirectly driven by means of an actuator, and a high-pressure accumulator, said internal combustion engine further including a control system which is designed to carry out any of the methods disclosed above.

BRIEF DESCRIPTION OF THE DRAWINGS

Example embodiments will be explained in more detail below with reference to figures, in which.

DETAILED DESCRIPTION

Figure 1:
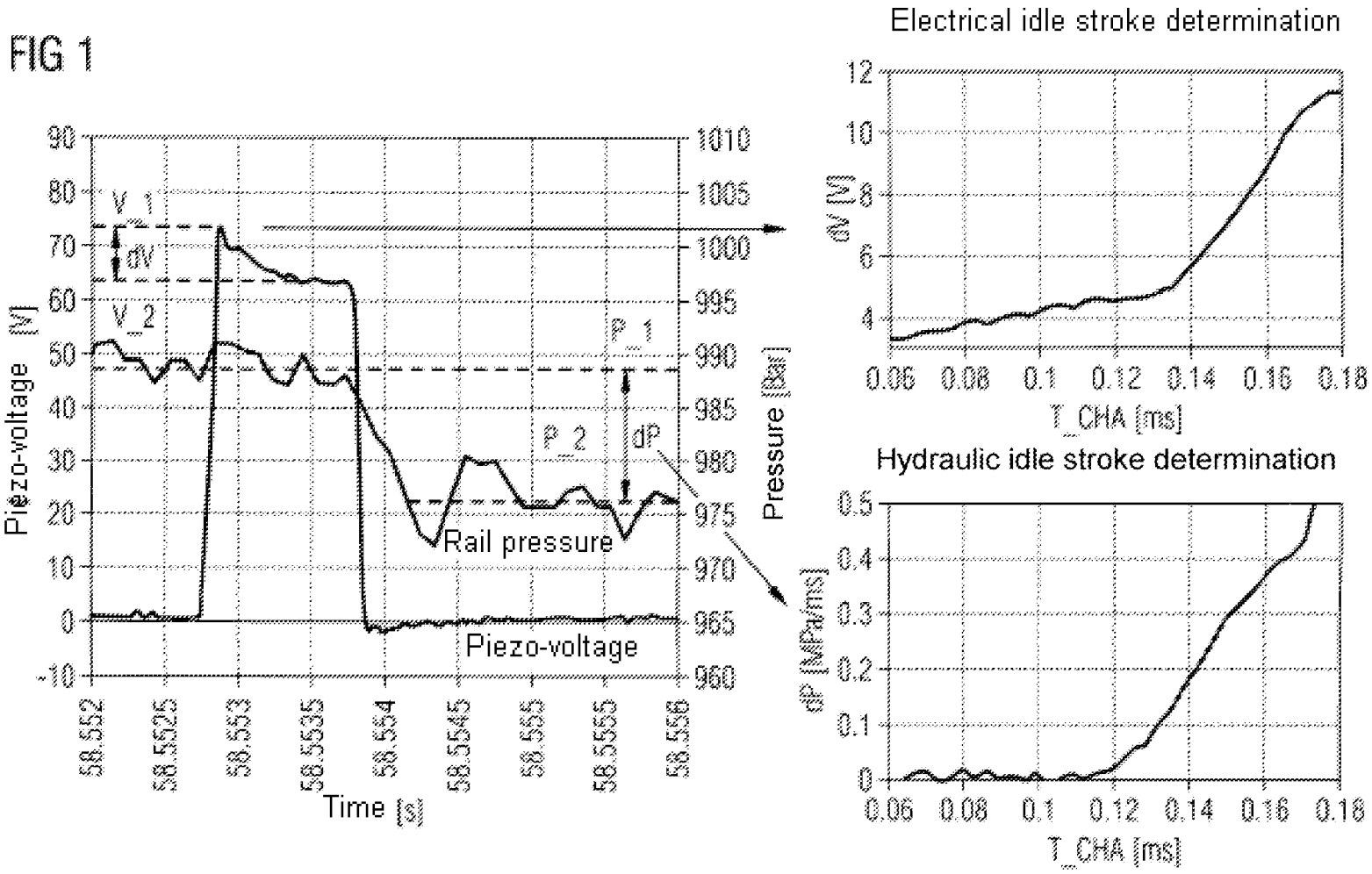
FIG. 1 shows, in the left-hand diagram, the injector voltage and the rail pressure during a test pulse as a function of the time, and in the two right-hand diagrams the voltage discontinuity and the pressure discontinuity as a function of the charge time of the piezo-actuator during the electrical and hydraulic idle stroke determination.

The present disclosure is based on the object of providing a method for operating an internal combustion engine which can be used to carry out a particularly precise injection over the service life of the injectors of the internal combustion engine.

According a first embodiment a method comprises:

continuously applying electrical test pulses with iteratively increasing energy to the actuator of the at least one injector during operating phases in which no pump delivery or normal injection takes place, and continuously hydraulically determining the idle stroke of the actuator by determining the pressure drop which is brought about thereby in the high-pressure accumulator; and making a corresponding correction to the injection time of the injector when a change in the pressure drop and therefore a change in the idle stroke are detected.

According to a second embodiment, a method comprises:

Continuously applying electrical test pulses with iteratively increasing energy to the actuator of the at least one injector, and continuously electrically determining the idle stroke of the actuator by determining the voltage drop brought about thereby at the actuator of the injector; and Making a corresponding correction to the injection time of the injector when a change in the voltage drop and therefore a change in the idle stroke compared to a comparison value are detected.

Some embodiments are designed to determine the idle stroke of the injector individually and continuously and to take into account changes in the idle stroke with respect to a reference value which occur, for example, due to wear, over the service life, owing to the temperature and the load profile, etc., using a correction in the injector actuation by carrying out an injection time correction.

In order to determine the idle stroke, two method variants are disclosed, specifically a hydraulic and an electrical method for determining the idle stroke, as well as a combination of both methods.

In this way, an optimized injection time correction is to be ensured in a continuous way in the entire working range of the internal combustion engine (pressure, temperature, number of injections), wherein depending on the partial range purely hydraulic, purely electrical or combined idle stroke determination is carried out. In an overlapping region, both methods can be applied in parallel, and reconciliation of the two methods can take place there.

Both method variants have in common the fact that electrical test pulses with iteratively increasing energy are applied to the injector in the injection system. The variables of the pressure in the high-pressure accumulator (common rail) or the electrical voltage at the actuator (piezo-actuator) of the injector, which are known in the system, are evaluated separately or in parallel here.

In the hydraulic method variant for determining the idle stroke, the pressure in the high-pressure accumulator is evaluated chronologically before and after a test pulse. As the energy of the test pulses increases, the actuator activates the servo valve after overcoming the idle stroke. The fuel which is under high pressure in the control space can escape via the return flow. Consequently, the pressure in the high-pressure accumulator drops since the fuel from the accumulator flows on into the control space. The level of the pressure drop dP=(Railpressure_before_Testpulse−Railpressure_after_Testpulse) owing to the actuation of the servo valve correlates with the stroke of the control valve piston, and therefore with the idle stroke of the injector. A change in the idle stroke of the injector can therefore be determined by measuring the pressure drop dP.

In the electrical method variant for idle stroke determination, the voltage signal at the actuator of the injector is analyzed during the test pulses. The test pulses are to be divided into three phases. In the first phase, electric charge is applied in a controlled fashion to the actuator. In the second phase—the holding phase—no transportation of charge between the control unit and the actuator takes place. In the third phase—the discharge phase—the charge is transported away from the actuator. The electrical voltage at the actuator is determined by the applied quantity of charge, the capacitance of the actuator and the force applied to the actuator. The capacitance of the actuator (piezo-actuator) changes only slightly with the temperature of the actuator. During an injection event, the capacitance is constant. The voltage difference between the end of the charging process of the actuator and the start of the discharging is accordingly a measure of the reduction in force at the actuator owing to the pressure drop in the control space by the opened control valve. This voltage drop therefore also correlates with the idle stroke of the injector. By measuring the voltage drop, it is therefore possible to determine a change in the idle stroke of the injector.

In the two method variants, the energy of the test pulse is therefore increased iteratively by increasing the charge time of the actuator (T_CHA). The pressure drop or pressure discontinuity dP(T_CHA) generated thereby in the first variant and the voltage drop or voltage discontinuity dV(T_CHA) in the second variant are recorded individually or together. The required energy which is necessary to reach a defined pressure discontinuity (dP_REF) or a defined voltage drop (dV_REF) correlates with the idle stroke of the injector.

The method of the hydraulic idle stroke determination has the advantage of high precision. The method can also be applied at low high-pressure accumulator pressures (rail pressures), in particular <60 MPa. There is a direct relationship with the opening behavior of the servo valve. However, the field of application is limited to ranges in which no pump delivery or injection takes place (i.e. the rail pressure is influenced only by the switching leak of the injector). Relatively long test pulses (typically 5 ms) are necessary for a given pressure signal resolution/signal scanning rate.

In contrast, the method of electrical idle stroke determination has the advantage that relatively short test pulses are necessary (typically <1 ms) and that the field of application is not restricted by the pump delivery. However, there is only an indirect relationship with the opening behavior of the servo valve, and the field of application is restricted to rail pressures >60 . . . 80 MPa.

In one embodiment of the method, the hydraulic and the electrical determination of the idle stroke are combined with one another, in particular in such a way that monitoring of the injector-specific idle stroke in a further field of application becomes possible. In particular, it is proposed here to carry out the hydraulic idle stroke determination in the lower pressure range of the high-pressure accumulator and/or lower rotational speed range of the internal combustion engine and to carry out the combined hydraulic and electrical idle stroke determination in a central pressure range of the high-pressure accumulator (transition region). The hydraulic idle stroke measurement is used in the lower rail pressure range and rotational speed range of the working range (approximately n<2000 rpm, P_Rail<100 MPa), since as a rule there is sufficient time available here for carrying out the test pulses with the necessary length. In a transition region (for example 120 MPa<P_Rail>60 MPa), usual reconciliation of the hydraulic and electrical idle stroke determination preferably takes place. For this purpose, the charge time of the injector is increased until the pressure drop or pressure discontinuity, measured parallel thereto, of the switching leak of the injector caused by the actuation exceeds a limiting value (dP_REV). At the same time, the voltage (piezo-voltage) at the end of the charging process of the injector minus the voltage (piezo-voltage) before the start of the discharging process is measured. The measured pressure discontinuity is placed in relationship with the measured voltage difference.

The resulting transmission function is then used to determine the limiting value for the voltage discontinuity dV_REF in the case of the sole application of the electrical idle stroke determination. This voltage discontinuity corresponds to an equivalent pressure discontinuity and represents a reference stroke of the actuator.

This transmission function can be stored as a function of the pressure in the control unit and can regularly be updated given simultaneous application of the hydraulic and electrical idle stroke determination. Changes in the electrical properties of the actuator (piezo-actuator) can be compensated as a result and the accuracy of the electrical idle stroke determination can be increased. In pressure ranges in which no parallel application of the electrical and hydraulic idle stroke determination can take place, according to a further embodiment of the method a reference voltage curve is formed from an overlapping pressure range from the profile of the reference voltage curve by means of a model.

Basically, either the hydraulic or the electrical idle stroke determination is therefore applied in the disclosed method as a function of the respective working point—characterized by the pressure, rotational speed and number of injections or the time period available for the idle stroke determination in the respective working cycle of the cylinder assigned to the injector. As mentioned, in a transition region it is possible to carry out hydraulic and electrical idle stroke determination in parallel, as a result of which the accuracy of the electrical idle stroke determination can be increased. As a result of this strategy, the idle stroke determination can be applied in a further characteristic diagram range and permits a change in the idle stroke to be corrected independently of the working point.

In this embodiment the injector-specific idle stroke is therefore determined by combining two methods which complement one another in their requests in such a way that idle stroke determination can be carried out continuously in the entire working range of the injector. The robustness of the method of the idle stroke determination is increased by a redundant signal which includes the same information.

Other embodiments provide an internal combustion engine having an injection system comprising at least one injector, which is indirectly driven by means of an actuator, and a high-pressure accumulator. The internal combustion engine is characterized in that it has a control system which is designed to carry out the method described above. The injection system is configured in such a way that electrical test pulses with iteratively increasing energy can be applied to the actuator (piezo-actuator) of the at least one injector.

The disclosed method will now be described with reference to an exemplary embodiment in which a hydraulic idle stroke determination and an electrical idle stroke determination are carried out in parallel with one another. In this context, electrical test pulses with iteratively increasing energy are applied to an indirectly driven piezo-fuel injector of an internal combustion engine, and the known system variables of the high-pressure accumulator pressure or rail pressure and the electrical voltage at the piezo-actuator of the injector are evaluated in parallel with one another.

In the left-hand diagram in FIG. 1, the injector voltage or piezo-voltage (V) and the high-pressure accumulator pressure or rail pressure (bar) during a test pulse of the idle stroke determination are illustrated. It is apparent that during the test pulse a voltage drop or voltage discontinuity dV and a rail pressure drop or rail pressure discontinuity dP are produced. The level of the pressure drop dP and the level of the voltage drop dV correlate with the idle stroke of the injector.

The energy of the test pulse is increased iteratively by increasing the charge time of the piezo-actuator (T_CHA). The pressure discontinuity dP(T_CHA) and the voltage discontinuity dV(T_CHA) are recorded in parallel. The two right-hand diagrams in FIG. 1 show the profile of the voltage discontinuity dV and of the pressure discontinuity dP as a function of the charge time of the piezo-actuator (T_CHA). The required energy, which is necessary to achieve a defined pressure discontinuity (dP_REF) or a defined voltage drop (dV_REF), therefore correlates with the idle stroke of the injector.

The electrical and hydraulic idle stroke determination which is carried out in this way on an injector-specific and continuous basis is used to determine changes in the idle stroke due to wear, service life, temperature and load profile, and an injection time correction is made as a function thereof.

Figure 2:
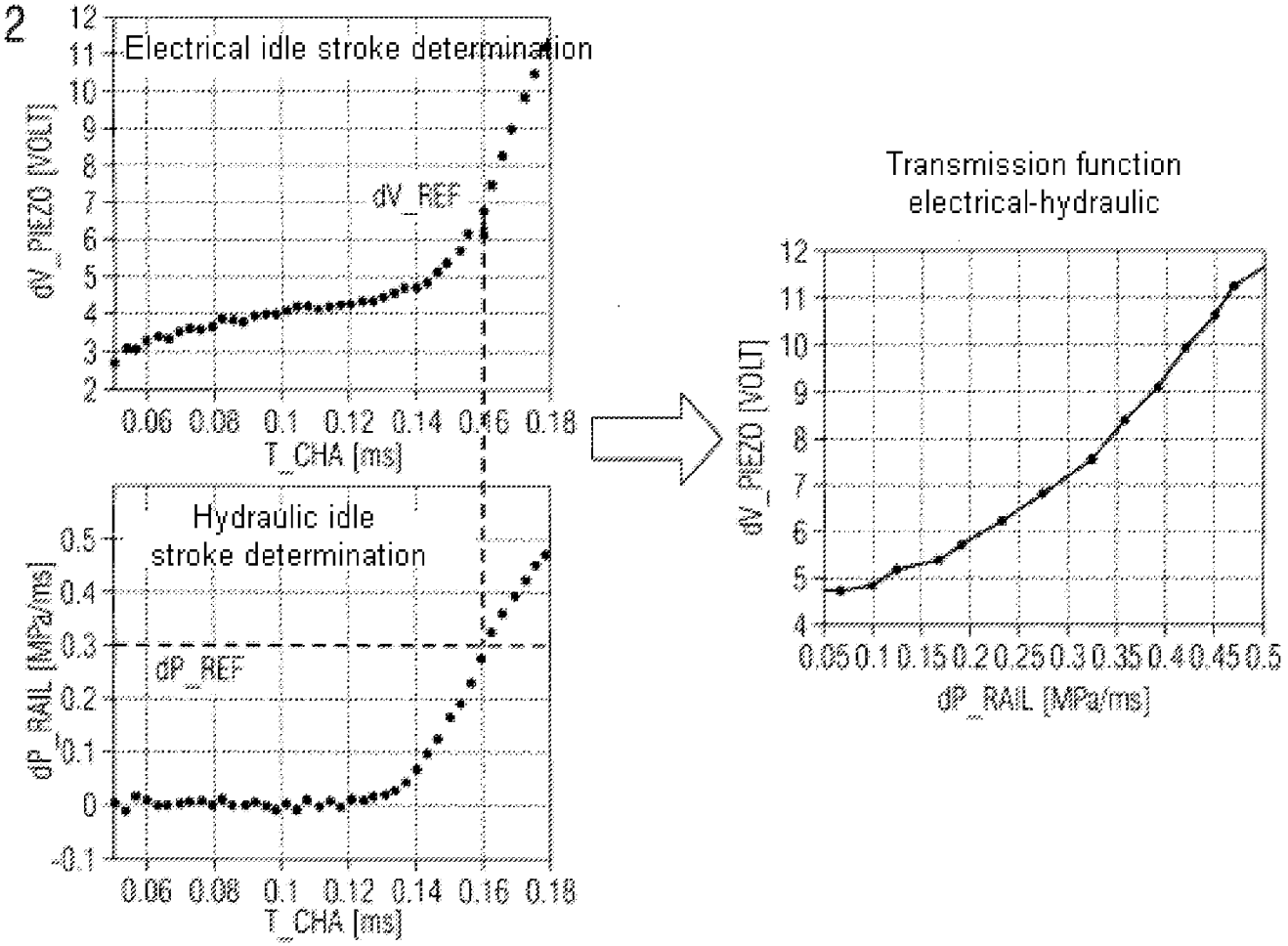
FIG. 2 shows, in the two left-hand diagrams, the hydraulic and electrical idle stroke determination analogously to the two right-hand diagrams in FIG. 1, and in the right-hand diagram a transmission function which is acquired by correlating the electrical and hydraulic idle stroke determination.

The pressure drop at the rail and the voltage drop at the piezo-actuator are determined synchronously. The two left-hand diagrams in FIG. 2 show the corresponding dV and dP curves of the hydraulic idle stroke determination in a way which is analogous to the two right-hand diagrams in FIG. 1. As mentioned, in order to determine the two curves the charge time of the injector is increased until the pressure discontinuity which is measured in parallel with this exceeds a limiting value dP_REF owing to the switching leak of the injector which is caused by the actuation. At the same time, the voltage difference, defined as the piezo-voltage at the end of the charging process of the injector minus the piezo-voltage before the start of the discharging process, is measured. The measured pressure discontinuity dP is placed in relationship with the measured voltage difference dV. In this context, the transmission function which is presented on the right in FIG. 2 is acquired.

This transmission function is then used to determine the limiting value for the voltage discontinuity dV_REF when the electrical idle stroke determination is used alone. This voltage discontinuity corresponds to an equivalent pressure discontinuity and represents a reference stroke of the piezo-actuator. The transmission function can be stored as a function of the pressure in the control unit. It is regularly updated with simultaneous application of the hydraulic and electrical idle stroke determination. Changes to the electrical properties of the piezo-actuator are compensated thereby and the accuracy of the electrical idle stroke determination is increased.

Figure 3:
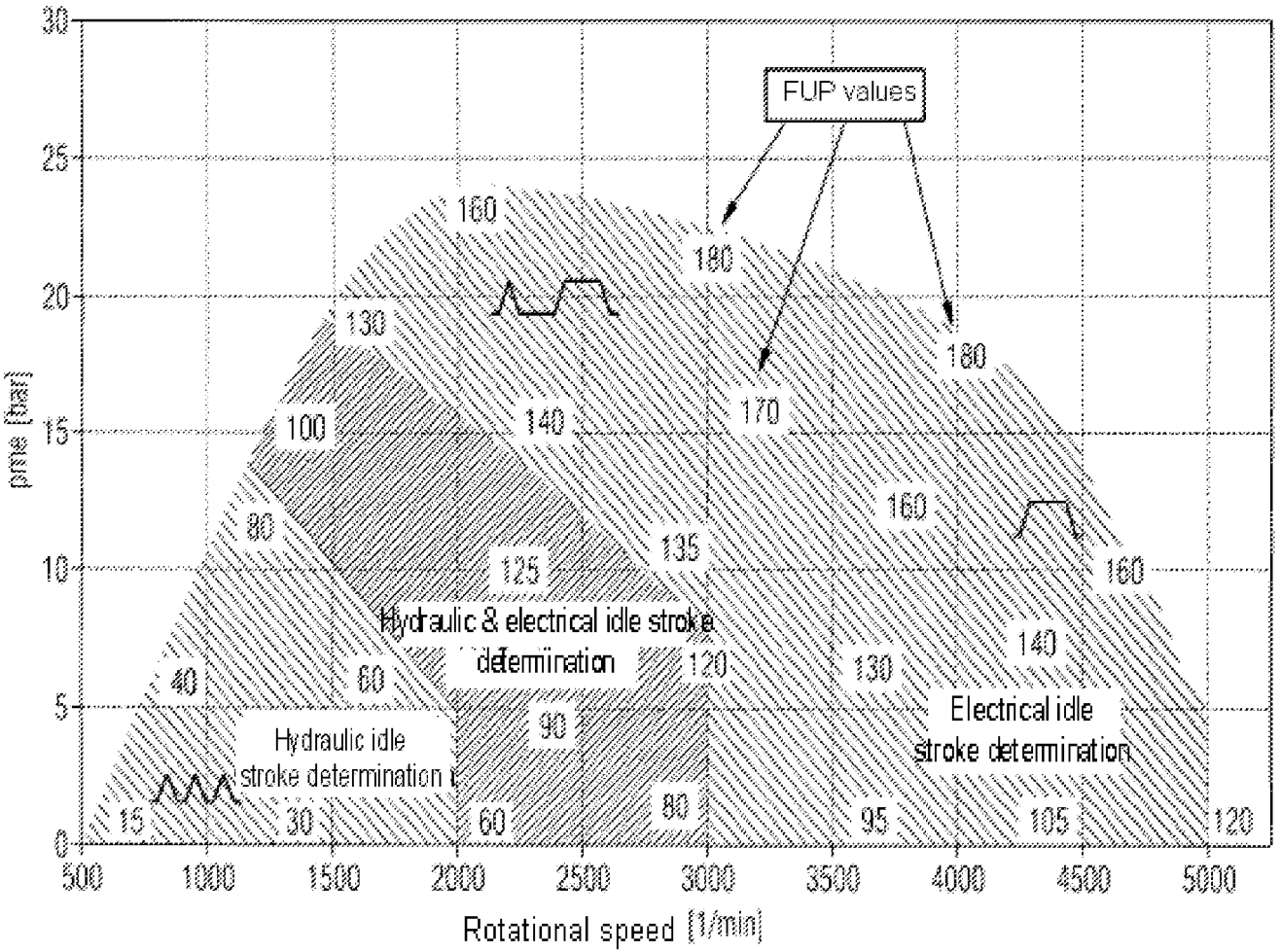
FIG. 3 shows typical fields of application of the hydraulic and electrical idle stroke determination and the overlapping region in which both methods can be applied in parallel (Load (pme=cylinder medium pressure) and rotational speed ranges, rail pressure setpoint values (FUP values))

In the disclosed method, the hydraulic and the electrical idle stroke determination are combined in such a way that monitoring of the injector-specific idle stroke in a further field of application becomes possible. FIG. 3 shows typical fields of application of the hydraulic and electrical idle stroke determination and the overlapping region in which both methods can be applied and reconciliation of the two methods can take place. In this context, the rotational speed (l/min) is plotted on the abscissa, and the cylinder medium pressure=load pme (bar) is plotted on the ordinate. In addition, corresponding rail pressure setpoint values (FUP values) are characterized. The left-hand hatched region shows a region in which only hydraulic idle stroke determination is carried out. The adjacent dotted region shows a region in which parallel hydraulic and electrical idle stroke determination is carried out. The right-hand hatched region represents the region in which only electrical idle stroke determination is carried out. In the transition region or overlapping region, regular reconciliation of the hydraulic and electrical idle stroke determination takes place, as mentioned above.

Figure 4:
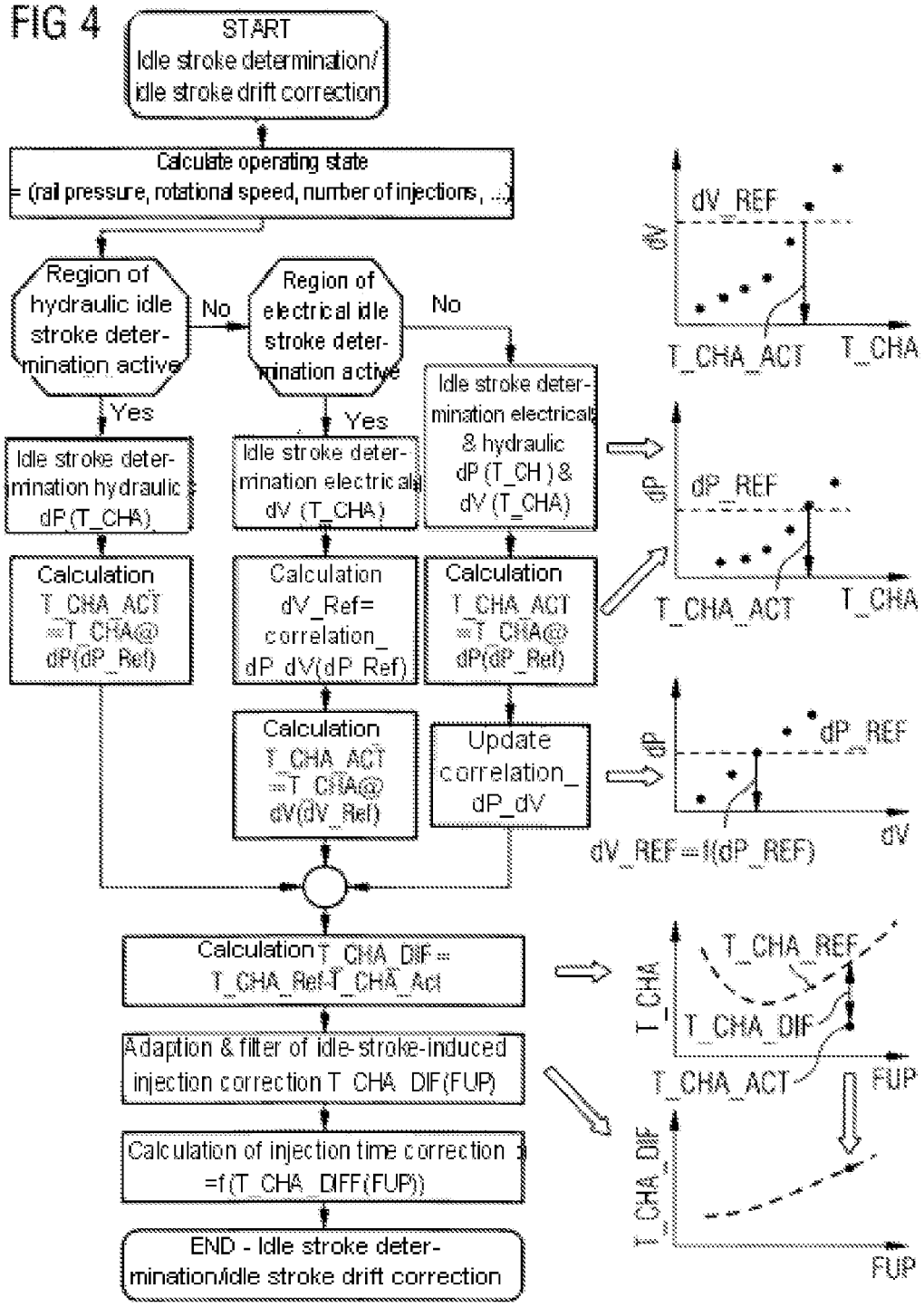
FIG. 4 shows a flowchart of the coordination between the electrical and hydraulic idle stroke determination.

FIG. 4 shows a flowchart of the coordination between the electrical and hydraulic idle stroke determination. In order to carry out the idle stroke determination or idle stroke drift correction, the operating state (rail pressure, rotational speed, number, injections, etc.) of the internal combustion engine is firstly calculated. If a region is present in which the hydraulic idle stroke determination is active, the hydraulic idle stroke determination takes place. After this, the charge time T_CH_ACT of the piezo-actuator is calculated. The calculated charge time is then subtracted from a reference charge time T_CH_REF, and a difference value T_CH_DIF is determined. This difference value is used, after adaptation and filtering, to determine the idle-stroke-induced injection correction T_CHA_DIF(FUP). The corresponding injection correction f(T_CHA_DIFF(FUP)) is acquired from this.

If there is no region of active hydraulic idle stroke determination present, it is checked whether a region of active electrical idle stroke determination is present. If this is the case, electrical idle stroke determination takes place, after which dV_Ref is calculated using the abovementioned transmission function, and the charge time T_CH_ACT of the actuator is calculated therefrom. The further steps then correspond to those of the hydraulic idle stroke determination described above.

If there is no region of active electrical idle stroke determination present either, combined hydraulic and electrical idle stroke determination takes place. The charge time T_CH_ACT of the actuator is calculated therefrom. The correlation _dP_dV is updated with this value. The same steps as in the case of the hydraulic and electrical idle stroke determination then follow.

What is claimed is:

1. A method for operating an internal combustion engine having an injection system comprising, an injector indirectly driven by an actuator, and a high-pressure accumulator, the method comprising:

repeatedly applying a series of electrical test pulses with iteratively increasing energy to the actuator of the injector during specified operating phases;

for a first series of the electrical test pulses:

hydraulically determining an idle stroke of the actuator by:

determining a pressure drop in the high-pressure accumulator resulting from each test pulse;

determining a particular test pulse for which the determined pressure drop exceeds a reference pressure drop corresponding to the idle stroke of the actuator;

determining a voltage drop at the actuator of the injector for each electrical test pulse; and determining the voltage drop corresponding to the determined particular test pulse; and updating, based on the voltage drop corresponding to the determined particular test pulse, a reference voltage used for electrically determining the idle stroke of the actuator; and for a second series of the electrical test pulses subsequent to the first series:

electrically determining the idle stroke of the actuator based on the updated reference voltage.

2. A method for operating an internal combustion engine having an injection system comprising an injector indirectly driven by an actuator, and a high-pressure accumulator, the method comprising:

repeatedly applying a series of electrical test pulses with iteratively increasing energy to the actuator of the injector;

repeatedly electrically determining an idle stroke of the actuator by:

for each series of electrical test pulses with iteratively increasing energy applied to the actuator:

determining a voltage drop at the actuator of the injector resulting from each test pulse; and comparing the voltage drop determined for each test pulse with a reference voltage corresponding to an idle stroke;

identifying, based on the comparisons, the first test pulse having a voltage drop that exceeds the reference voltage, and defining the energy applied to the actuator during the first test pulse as an idle stroke voltage representing the idle stroke of the actuator;

identifying a change in the determined idle stroke voltage over time, the change in the determined idle stroke voltage representing a change in the idle stroke of the actuator over time; and making a corresponding correction to the injection time of the injector in response to detecting the change in the determined idle stroke voltage over time.

3. The method of claim 2, comprising, in parallel with the repeated electrically determination of the idle stroke, repeatedly hydraulically determining the idle stroke of the actuator by determining a pressure drop in the high-pressure accumulator for each electrical test pulse.

4. The method of claim 2, further comprising repeatedly hydraulically determining, the idle stroke of the actuator by determining a pressure drop in the high-pressure accumulator for each of a series of electrical test pulses, wherein the repeated hydraulic determination of the idle stroke, or the repeated electrical determination of the idle stroke, or a combined hydraulic and electrical idle stroke determination is carried out as a function of a respective working point of the internal combustion engine.

5. The method of claim 4, wherein the combined hydraulic and electrical idle stroke determination is carried out in a defined central pressure range of the high-pressure accumulator.

6. The method of claim 4, wherein the combined hydraulic and electrical determination of the idle stroke includes correlating the pressure drop determined during the hydraulic determination of the idle stroke with the voltage drop determined during the electrical determination of the idle stroke to define a transmission function, which is used as a reference function during a subsequent electrical determination of the idle stroke.

7. The method of claim 4, wherein in pressure ranges in which no parallel hydraulic and electrical idle stroke determination can take place, a reference voltage curve is formed from an overlapping pressure range from the profile of a reference voltage curve according to a model.

8. An internal combustion engine, comprising:

an injection system comprising an injector indirectly driven by means of an actuator, and a high-pressure accumulator; and a control system programmed to:

repeatedly apply a series of electrical test pulses with iteratively increasing energy to the actuator of the injector during specified operating phases;

for a first series of the electrical test pulses:

hydraulically determine an idle stroke of the actuator by:

determining a pressure drop in the high-pressure accumulator resulting from each test pulse;

determining a particular test pulse for which the determined pressure drop exceeds a reference pressure drop corresponding to the idle stroke of the actuator;

determine a voltage drop at the actuator of the injector for each electrical test pulse; and determine the voltage drop corresponding to the determined particular test pulse; and update, based on the voltage drop corresponding to the determined particular test pulse, a reference voltage used for electrically determining the idle stroke of the actuator; and for a second series of the electrical test pulses subsequent to the first series:

electrically determine the idle stroke of the actuator based on the updated reference voltage.

* * * * *